US006585364B2

(12) United States Patent
Kasperchik et al.

(10) Patent No.: US 6,585,364 B2
(45) Date of Patent: Jul. 1, 2003

(54) METHODS AND APPARATUS FOR IMPROVING INKJET PRINT QUALITY

(75) Inventors: Vladek P Kasperchik, Corvallis, OR (US); William J Allen, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/867,726

(22) Filed: May 29, 2001

(65) Prior Publication Data

US 2002/0180855 A1 Dec. 5, 2002

(51) Int. Cl.[7] ..... B41J 2/17; B41J 2/01

(52) U.S. Cl. ..... 347/98; 347/102; 347/100; 347/101

(58) Field of Search ..... 347/102, 100, 347/101, 98, 96, 103, 106, 95, 1; 428/195; 346/158

(56) References Cited

U.S. PATENT DOCUMENTS 5,597,680 A * 1/1997 Wang et al. ..... 430/523
5,618,338 A * 4/1997 Kurabayashi et al. ..... 347/100
5,631,071 A * 5/1997 Fukunishi et al. ..... 347/106
5,786,835 A * 7/1998 Ikeda et al. ..... 347/106
6,068,372 A * 5/2000 Rousseau et al. ..... 347/103
6,084,619 A * 7/2000 Takemoto et al. ..... 347/100
6,126,281 A * 10/2000 Shimoda et al. ..... 347/101
6,238,045 B1 * 5/2001 Ono et al. ..... 347/100

FOREIGN PATENT DOCUMENTS

| | | |
|---|---|---|
| EP | 0534634 | 3/1993 |
| JP | 63299970 | 7/1988 |

* cited by examiner

*Primary Examiner*—Raquel Yvette Gordon
*Assistant Examiner*—Cmanish Shah

(57) ABSTRACT

Methods and apparatus for in-line conditioning of swellable print media prior to printing. Treatment with an amphiphilic solvent increases the hydrophilicity of the media surface, thereby accelerating ink penetration and improving image quality in high throughput printing. In addition, ionic components in the treatment fluid can be used to accelerate precipitation of pigment or dye from the ink.

21 Claims, 1 Drawing Sheet

METHODS AND APPARATUS FOR IMPROVING INKJET PRINT QUALITY

FIELD OF THE INVENTION

The present invention relates to methods and apparatus for treating swellable media in inkjet printing. In particular, it relates to methods and apparatus for pretreating media with fluid and/or heat immediately before printing to accelerate ink penetration and reduce coalescence.

BACKGROUND OF THE INVENTION

Inkjet print media comprising a swellable ink-receiving layer (e.g., gelatin and other hydrogels such as polyvinylpyrrolidone and copolymers including polyvinyl alcohol or polyethylene oxide) are commonly used for inkjet photo-imaging. These media (typically coated papers) tend to provide better lightfastness and durability than porous media (such as plain or coated paper), and sometimes improve image quality, as well. However, swellable ink-receiving layers are frequently subject to a problem of slow ink uptake. The time it takes for an ink-receiving layer to swell and absorb ink from a surface is often longer than the time needed for a porous medium to absorb ink. At high print speeds, ink may puddle or "coalesce" before it is fully absorbed, limiting achievable image quality.

It is an object of the present invention to provide an inexpensive method and apparatus to reduce coalescence and improve image quality.

SUMMARY OF THE INVENTION

In one aspect, the invention comprises a method of improving print quality for a printer that prints to a swellable medium. The method comprises applying treatment fluid to the swellable medium, no more than one minute before the ink is applied to the medium. This may be accomplished, for example, by the use of an in-line apparatus that applies the treatment fluid to the medium as it passes through the printer, before it reaches the print head, for example by a roller, a wiper, a sprayer or an inkjet printhead. The time between application of the treatment fluid and the ink to the medium may be, for example, no greater than fifteen seconds, five seconds, or one second. The medium may be heated while or immediately after the treatment fluid is applied. The treatment fluid may be selected to increase the hydrophilicity of the swellable medium. For example, it may comprise a polar solvent (e.g., water) and a wetting agent or a surfactant. It may further contain drying agents. In some embodiments, the treatment fluid comprises about 5–30% alcohols and/or diols (e.g., about 8–20% 1,2-hexanediol and about 2–5% 1-butanol), about 1–4% surfactant (e.g., about 1–4% secondary alcohol ethoxylate), and about 71–89% water.

In another aspect, the invention comprises a method of improving image quality by applying a treatment fluid to a print medium, where the treatment fluid is selected to cause rapid precipitation of a colorant from ink used to print to the print medium. The colorant may be, for example, a pigment or a dye. The treatment fluid and the ink may be selected so that the colorant forms an insoluble salt with the treatment fluid, thereby precipitating the colorant.

In a further aspect, the invention comprises a printer for applying a treatment fluid to print media. The printer comprises a pretreatment applicator than applies the treatment fluid, and an ink jet that applies ink no more than about one minute after the treatment fluid is applied. The printer may also comprise a feeder that feeds the print media over the pretreatment applicator before it is brought into communication with the inkjet. The pretreatment applicator may comprise, for example, a roller (e.g., a microporous roller) and a fluid reservoir, where the passage of the print media over the applicator causes the roller to apply fluid from the reservoir to the print media. Optionally, the printer may also comprise a heater that heats the print media adjacent to the pretreatment applicator.

BRIEF DESCRIPTION OF THE DRAWING

The invention is described with reference to the several figures of the drawing, in which.

DETAILED DESCRIPTION

Figure 1:
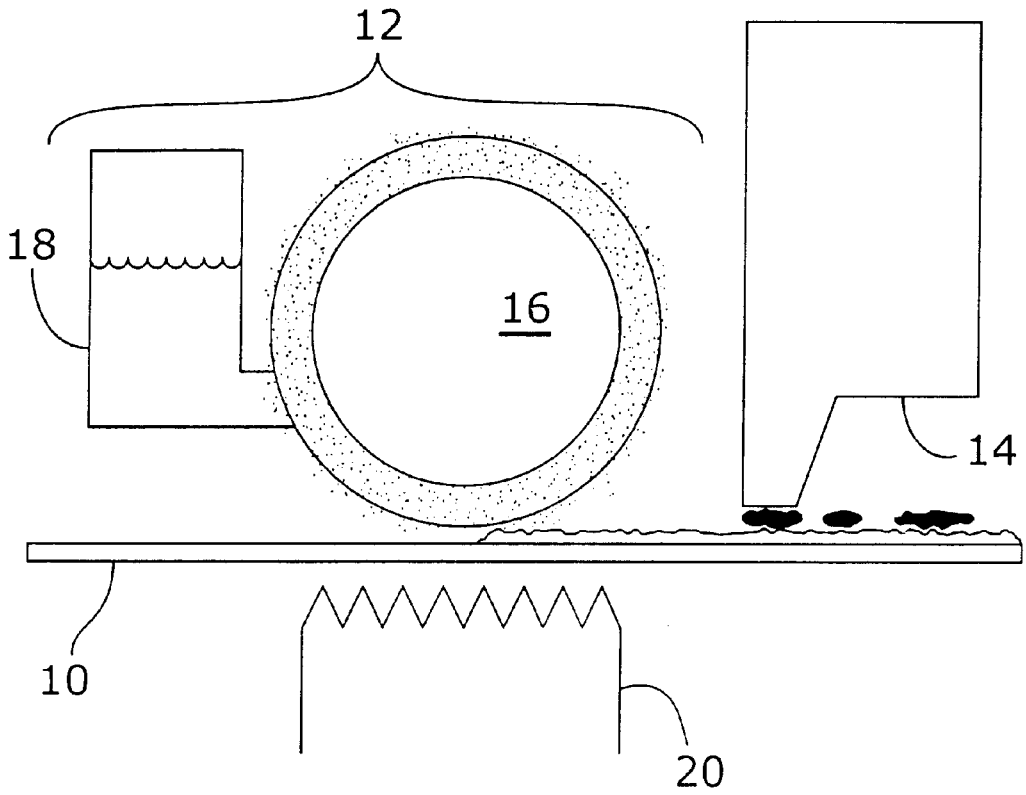
FIG. 1 shows a media pretreatment applicator and print head in a printer according to the invention.

Initial slow wetting and swelling of swellable media by ink are believed to be caused by a delay in polymer surface readjustment. Polymer surfaces are mobile systems that constantly readjust themselves with respect to their environment in order to minimize interfacial energy. In the case of the many swellable media that comprise polymers having both hydrophilic and hydrophobic portions, this adjustment includes modification of the hydrophilicity of the surface in response to changes in the local environment. Portions of the polymer chains shift to place the hydrophilic or hydrophobic portions of the chains at the polymer/air interface. A humid environment tends to increase the hydrophilicity of the surface, while a dry environment tends to reduce hydrophilicity. The readjustment of the surface characteristics is usually temperature-dependent and occurs more quickly at higher temperatures.

Faster wetting and absorption of typical inks are facilitated when media surfaces are strongly hydrophilic. This can be accomplished by using strong wetting agents and aggressive solvents in the ink formula, but these can be damaging to the ink supply and delivery system, and often tend to degrade the overall inkjet system reliability.

Faster wetting can also be accomplished by heating the media just before or in the print zone to speed up the adjustment of the polymer surface upon exposure to the ink. However, this approach can increase the sensitivity of the system to environmental conditions. When the media are preheated in a low humidity environment, their surfaces may become even drier, decreasing their initial wettability. Some high-end machines may have mechanisms to compensate for environmental temperature and humidity variations, but these systems add significant complexity to the printing systems.

The present invention overcomes these shortcomings by chemically adjusting the hydrophilicity of the swellable media surface prior to printing. An amphiphilic solvent is used, preferably in conjunction with heating, prior to the application of ink. Such a solvent accelerates shifting of the polymer chains at the media surface in response to environmental changes. In preferred embodiments, the solvent is applied via a microporous roller, although other methods of application such as wipers and sprayers also fall within the scope of the invention.

Solvents used according to the invention preferably comprise polar solvents (e.g., water) and wetting agents (e.g., alcohols and diols) and/or surfactants (e.g., secondary alcohol ethoxylates such as $(C_{12-14}H_{25-29})$—O—$(CH_2CH_2O)_{5-7}$—H). One solvent suitable for use with the invention comprises about 8–20% 1,2 hexanediol, about 2–5% 1-butanol, about 1–4% secondary alcohol ethoxylate, and about 71–89% water.

In the embodiment of the invention shown in FIG. 1, media 10 is fed through pretreatment applicator 12 before passing under the print head 14. The pretreatment system includes a roller 16 and a reservoir 18 for the treatment fluid. Optionally, a heater 20 may also be used to heat the media as the treatment fluid is applied by the roller 16. Alternatively, the roller itself may be heated, or the media may be heated by other systems before reaching the pretreatment applicator.

In the embodiment shown, by selecting the appropriate microporous material for the roller 16, the desired quantity of treatment fluid may be applied to the media 10 without need for a complex delivery or metering apparatus. For example, the ACU-RATE® Oil Supply Rolls made by W. L. Gore & Associates should be suitable for this purpose. Embodiments comprising delivery or metering apparatus also fall within the scope of the invention, however.

The media 10 travels continuously past the applicator 12 to the print head 14. Thus, the time delay between surface treatment and application of ink is short (less than a minute, preferably less than 5 seconds, more preferably less than 1 second). Prior art systems have attempted to modify the surface chemistry of media outside the printer, but these systems must allow for possible long-term storage of media under varying environmental conditions.

In-line pretreatment of media according to the invention has several advantages. Pretreatment accelerates ink penetration into the ink-receiving layer of the media, increasing dot gain, providing smoother color transitions, and reducing coalescence while enabling higher throughput printing. Increased dot gain may reduce the amount of ink required to achieve saturated colors, thereby decreasing the cost per page of printing and improving pen reliability.

Further, the in-line conditioning of the media reduces the fundamental environmental sensitivity of the ink/medium interaction. According to the present invention, the media passes through the treatment "sauna" immediately before printing, which may overwhelm prior environmental effects. As a result, compensation for environmental conditions may be obviated.

In addition, pretreatment of the media surface according to the invention allows the use of inks having less aggressive solvents and wetting agents. Since these components can cause significant degradation of ink feeding mechanisms, the reliability of the system can be enhanced by the use of the invention. The simpler mechanisms used to apply a continuous coating of the pretreatment fluid are easier to design to avoid these reliability problems than the relatively complex structure of a print head.

The apparatus of the invention may also be used for other types of media pretreatment. For example, when printing with pigmented inks, a solution can be applied that interacts with the pigment carrier to cause the pigment to be rapidly precipitated out of solution. By not relying on evaporation and/or absorption to remove the carrier, the pigment can be more precisely placed, resulting in improved optical density and edge acuity of the printout. These properties can also be improved for black pigment by underprinting with colored ink for many plain papers, but using the pretreatment method of the invention speeds throughput (since ink-jet printers typically have more nozzles for black ink than for colors). Further, by applying the solution uniformly to the medium before printing, pigments of all colors may be "crashed" out of solution, improving color saturation as well as edge acuity. A similar technique may be used for certain dyes.

For pigments stabilized by absorption of an anionic polymer dispersant, self-dispersed pigments having anionic charges on their surfaces, or anionic dyes, the pretreatment liquid may comprise a cationic component (e.g., polyvalent metal cations such as $Ca^{2+}$, $Mg^{2+}$, or $Fe^{3+}$; cationic polymers such as polyethylene amines, polyethylene imines, or polymeric quaternary amines; or cationic surfactants) that forms an insoluble salt with the anionic component of the pigment or dye. When the ink is deposited on the treated medium, the cationic component of the pretreatment liquid forms a salt with the anionic component of the ink, which "crashes" out of solution rapidly. Because the removal of the dye or pigment from the solvent is so rapid, there is less dispersion of the dye or pigment, resulting in improved edge acuity. Of course, this technique may also be used to stabilize cationic dyes and cationically stabilized pigments, by including an anion in the pretreatment liquid (e.g., polymers or surfactants containing —$SO_3^-$ or $COO^-$ groups).

These precipitating agents of the pretreatment liquid may be used in conjunction with the wetting agents and surfactants used to accelerate ink penetration. The precipitating agent should be selected to be stable in solution with the wetting agents and surfactants, and the latter should be selected not to unduly reduce the colorant-precipitating capability of the precipitating agent.

Other embodiments of the invention will be apparent to those skilled in the art from a consideration of the specification or practice of the invention disclosed herein. It is intended that the specification and examples be considered as exemplary only, with the true scope of the invention being indicated by the following claims.

What is claimed is:

1. A method of improving print quality in a printer that applies ink to a swellable medium, comprising:

applying a treatment fluid to the swellable medium, the treatment fluid tending to chemically accelerate the absorption of ink by the swellable medium;

applying heat to the medium while or immediately after applying the treatment fluid; and applying ink to the swellable medium, wherein the ink is applied to the swellable medium within about one minute after the treatment fluid is applied.

2. The method of claim 1, wherein the ink is applied to the swellable medium within about fifteen seconds after the treatment fluid is applied.

3. The method of claim 1, wherein the ink is applied to the swellable medium within about five seconds after the treatment fluid is applied.

4. The method of claim 1, wherein the ink is applied to the swellable medium within about one second after the treatment fluid is applied.

5. The method of claim 1, wherein the treatment fluid tends to increase the hydrophilicity of a surface of the swellable medium.

6. The method of claim 5, wherein the treatment fluid comprises:

a polar solvent; and a wetting agent or a surfactant.

7. The method of claim 5, wherein the treatment fluid comprises about 5–30% solvents selected from the group consisting of alcohols, diols, and mixtures thereof;

about 1–4% surfactant; and about 71–89% water.

8. The method of claim 5, wherein the treatment fluid comprises:

about 8–20% 1,2-hexanediol;

about 2–5% 1-butanol;

about 1–4% secondary alcohol ethoxylate; and about 71–89% water.

9. The method of claim 1, wherein the treatment fluid further comprises a drying agent.

10. The method of claim 1, wherein the treatment fluid is applied with a roller, a wiper, a sprayer or an inkjet printhead.

11. The method of claim 1, wherein the ink comprises a colorant and a carrier and the treatment fluid is selected to interact with the ink by causing rapid precipitation of the colorant from the carrier.

12. The method of claim 11, wherein the colorant is cationic and the treatment fluid interacts with the cationic colorant by forming an insoluble salt.

13. The method of claim 11, wherein the colorant is anionic and treatment fluid includes a polyvalent metal cation that interacts with the anionic colorant by forming an insoluble salt.

14. An ink-jet printer that applies ink to a swellable medium, comprising:

a pretreatment applicator that applies a treatment fluid to the swellable medium, the treatment fluid selected to chemically increase the hydrophilicity of a surface of the swellable medium;

an ink jet that applies ink to the swellable medium, the ink being applied within about one minute after the treatment fluid is applied;

a heater that heats the swellable medium adjacent to the pretreatment applicator.

15. The ink-jet printer of claim 14, further comprising a feeder that feeds the swellable medium through the printer, wherein the feeder causes a portion of the swellable medium to pass over the pretreatment applicator before being brought into contact with the ink jet.

16. The ink-jet printer of claim 14, wherein the pretreatment applicator comprises a roller and a fluid reservoir, wherein passage of the swellable medium over the applicator causes the roller to apply treatment fluid from the fluid reservoir to the swellable medium.

17. The ink-jet printer of claim 16, wherein the roller comprises a microporous material.

18. The ink-jet printer of claim 14, wherein in operation the ink is applied to the swellable medium within about fifteen seconds after the treatment fluid is applied.

19. The ink-jet printer of claim 14, wherein in operation the ink is applied to the swellable medium within about five seconds after the treatment fluid is applied.

20. The ink-jet printer of claim 14, wherein in operation the ink is applied to the swellable medium within about one second after the treatment fluid is applied.

21. The ink-jet printer of claim 14, wherein in operation the swellable medium is heated while or immediately after the treatment fluid is applied.

* * * * *